US008985940B2

(12) United States Patent
Zhang et al.

(10) Patent No.: US 8,985,940 B2
(45) Date of Patent: Mar. 24, 2015

(54) TURBINE COOLING APPARATUS

(75) Inventors: Luzeng Zhang, San Diego, CA (US); Xubin Gu, San Diego, CA (US); Juan Yin, San Diego, CA (US); Hee Koo Moon, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 466 days.

(21) Appl. No.: 13/436,009

(22) Filed: Mar. 30, 2012

(65) Prior Publication Data

US 2013/0259704 A1 Oct. 3, 2013

(51) Int. Cl.

| | |
|---|---|
| ***F01D 5/18*** | (2006.01) |
| ***F01D 5/08*** | (2006.01) |
| ***F01D 25/08*** | (2006.01) |
| ***F01D 25/12*** | (2006.01) |

(52) U.S. Cl.

CPC ..... *F01D 5/081* (2013.01); *F01D 5/082* (2013.01); *F01D 5/186* (2013.01); *F01D 5/188* (2013.01); *F01D 5/189* (2013.01); *F01D 25/08* (2013.01); *F01D 25/12* (2013.01)

USPC ..... 415/115; 416/97 R

(58) Field of Classification Search

USPC ..... 415/115; 416/96 A, 96 R, 97 A, 97 R

See application file for complete search history.

(56) References Cited

U.S. PATENT DOCUMENTS

| | | | | |
|---|---|---|---|---|
| 4,278,400 | A | 7/1981 | Yamarik et al. | |
| 4,604,031 | A * | 8/1986 | Moss et al. | 416/97 R |
| 4,992,026 | A | 2/1991 | Ohtomo et al. | |
| 5,498,126 | A | 3/1996 | Pighetti et al. | |
| 5,507,621 | A | 4/1996 | Cooper | |
| 5,669,759 | A | 9/1997 | Beabout | |
| 5,772,397 | A * | 6/1998 | Morris et al. | 415/115 |
| 6,183,194 | B1 | 2/2001 | Cunha et al. | |
| 6,257,830 | B1 | 7/2001 | Matsuura et al. | |
| 6,631,561 | B1 | 10/2003 | Anding et al. | |
| 6,939,102 | B2 * | 9/2005 | Liang | 415/115 |
| 7,137,784 | B2 * | 11/2006 | Hall et al. | 416/97 R |
| 7,625,178 | B2 | 12/2009 | Morris et al. | |
| 8,016,563 | B1 * | 9/2011 | Liang | 416/97 R |
| 2004/0076519 | A1 | 4/2004 | Halfmann et al. | |
| 2005/0042096 | A1 | 2/2005 | Hall et al. | |

FOREIGN PATENT DOCUMENTS

| | | |
|---|---|---|
| EP | 1223308 A2 | 7/2002 |
| WO | 2008155248 | 12/2008 |

* cited by examiner

*Primary Examiner* — Dwayne J White
*Assistant Examiner* — William Grigos
(74) *Attorney, Agent, or Firm* — Finnegan, Henderson, Farabow, Garrett & Dunner, LLP

(57) ABSTRACT

A turbine blade for a gas turbine engine is disclosed. The turbine blade can include at least one internal cooling path, and an internal vane disposed in the at least one internal cooling path. The internal vane can include a central portion, a first leg extending in a first direction from the central portion, and a second leg extending in a second direction from the central portion. The central portion can have a thickness greater than a thickness of the first leg or a thickness of the second leg.

15 Claims, 5 Drawing Sheets

TURBINE COOLING APPARATUS

TECHNICAL FIELD

The present disclosure relates generally to gas turbine engine cooling, and more particularly to the cooling of turbine blades in a gas turbine engine (GTE).

BACKGROUND

GTEs produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. In a typical turbine engine, one or more fuel injectors direct a liquid or gaseous hydrocarbon fuel into the combustor for combustion. The resulting hot gases are directed over blades of the turbine to spin the turbine and produce mechanical power.

High performance GTEs include cooling passages and cooling fluid to improve reliability and cycle life of individual components within the GTE. For example, in cooling the turbine section, cooling passages are provided within the turbine blades to direct a cooling fluid therethrough. Conventionally, a portion of the compressed air is bled from the air compressor to cool components such as the turbine blades. The amount of air bled from the air compressor, however, is limited so that a sufficient amount of compressed air is available for engine combustion to perform useful work.

U.S. Pat. No. 7,137,784 to Hall et al. (the '784 patent) describes a thermally loaded component having at least one cooling passage for the flow of a cooling fluid therethrough. According to the '784 patent, a blade or vane of a turbomachine may incorporate diverter blades to divert cooling fluid into cooling passages. The diverter blades include first and second diverter parts spaced at a distance from one another over a height of a cooling passage.

SUMMARY

In one aspect, a turbine blade for a gas turbine engine is disclosed. The turbine blade can include at least one internal cooling path, and an internal turning vane disposed in the at least one internal cooling path. The internal vane can include a central portion, a first leg extending in a first direction from the central portion, and a second leg extending in a second direction from the central portion. The central portion can have a thickness greater than a thickness of the first leg or a thickness of the second leg. is disclosed.

In another aspect, a turbine blade for a gas turbine engine is disclosed. The turbine blade can include at least one internal cooling path, and at least one vane disposed in the at least one internal cooling path. The at least one vane can include a central portion, and a leg extending from the central portion. The central portion can have a thickness greater than a thickness of the leg.

In yet another aspect, a turbine blade for a gas turbine engine is disclosed. The turbine blade can include an internal cooling path, a first vane disposed at a first location in the cooling path, and a second vane disposed at a second location in the cooling path downstream from the first location. The first and second vane can each taper from a central thickness to a first thickness, and from the central thickness to a second thickness. The first thickness can be disposed upstream from the central thickness in the cooling path, and the central thickness can be disposed upstream from the second thickness in the cooling path.

DETAILED DESCRIPTION

Figure 1:
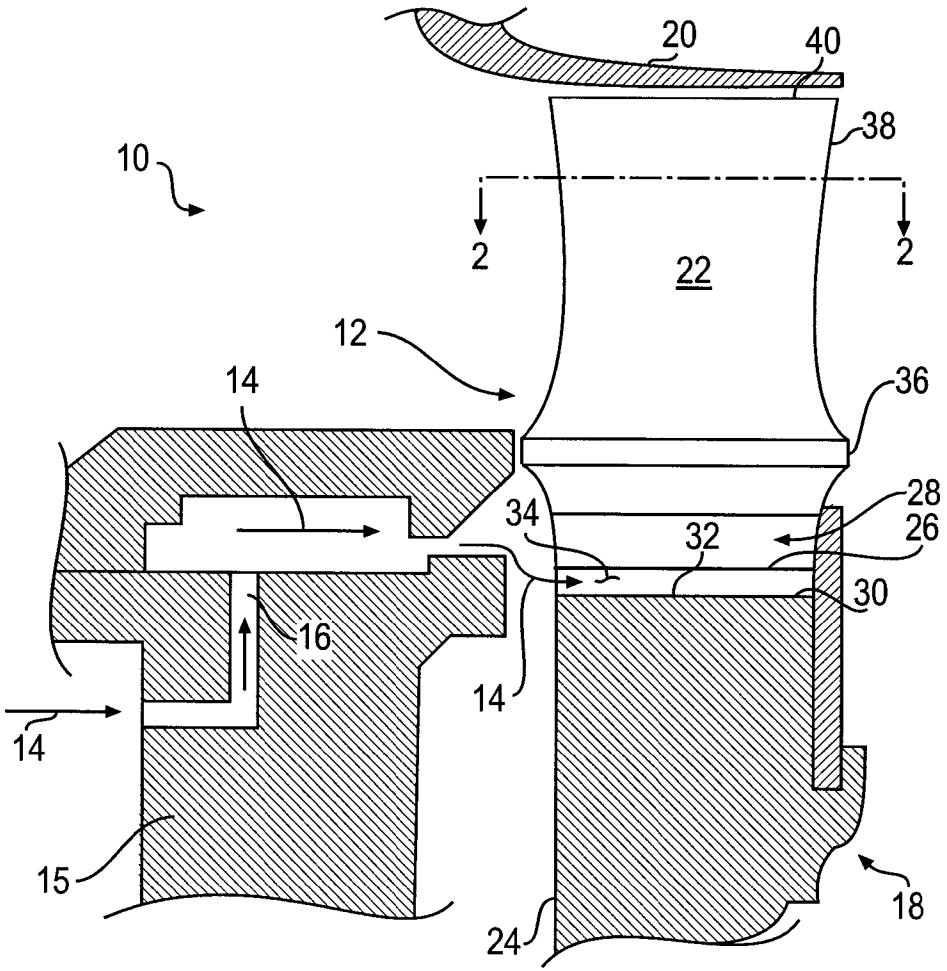
FIG. 1 is a sectional view of a portion of a turbine section of a gas turbine engine.

FIG. 1 illustrates a sectional view of a portion of a GTE, specifically a turbine section 10 of the GTE. The turbine section 10 includes a first stage turbine assembly 12 disposed partially within a first stage shroud assembly 20.

During operation, a cooling fluid, designated by the arrows 14, flows from the compressor section (not shown) to the turbine section 10. Furthermore, each of the combustion chambers (not shown) are radially disposed in a spaced apart relationship with respect to each other, and have a space through which the cooling fluid 14 flows to the turbine section 10. The turbine section 10 further includes a support structure 15 having a fluid flow channel 16 through which the cooling fluid 14 flows.

The first stage turbine assembly 12 includes a rotor assembly 18 radially aligned with the shroud assembly 20. The rotor assembly 18 may be of a conventional design including a plurality of turbine blades 22. The turbine blades 22 may be made from any appropriate materials, for example metals or ceramics. The rotor assembly 18 further includes a disc 24 having a plurality of circumferentially arranged root retention slots 30. The plurality of turbine blades 22 are replaceably mounted within the disc 24. Each of the plurality of blades 22 may include a first end 26 having a root section 28 extending therefrom which engages with one of the corresponding root retention slots 30. The first end 26 may be spaced away from a bottom of the root retention slot 32 in the rotor assembly 18 to form a cooling fluid inlet opening 34 configured to receive cooling fluid 14. Each turbine blade 22 may further include a platform section 36 disposed radially outward from a periphery of the disc 24 and the root section 28. Additionally, an airfoil 38 may extend radially outward from the platform section 36. Each of the plurality of turbine blades 22 may include a second end 40, or tip, positioned opposite the first end 26 and adjacent the shroud 20.

Figure 2:
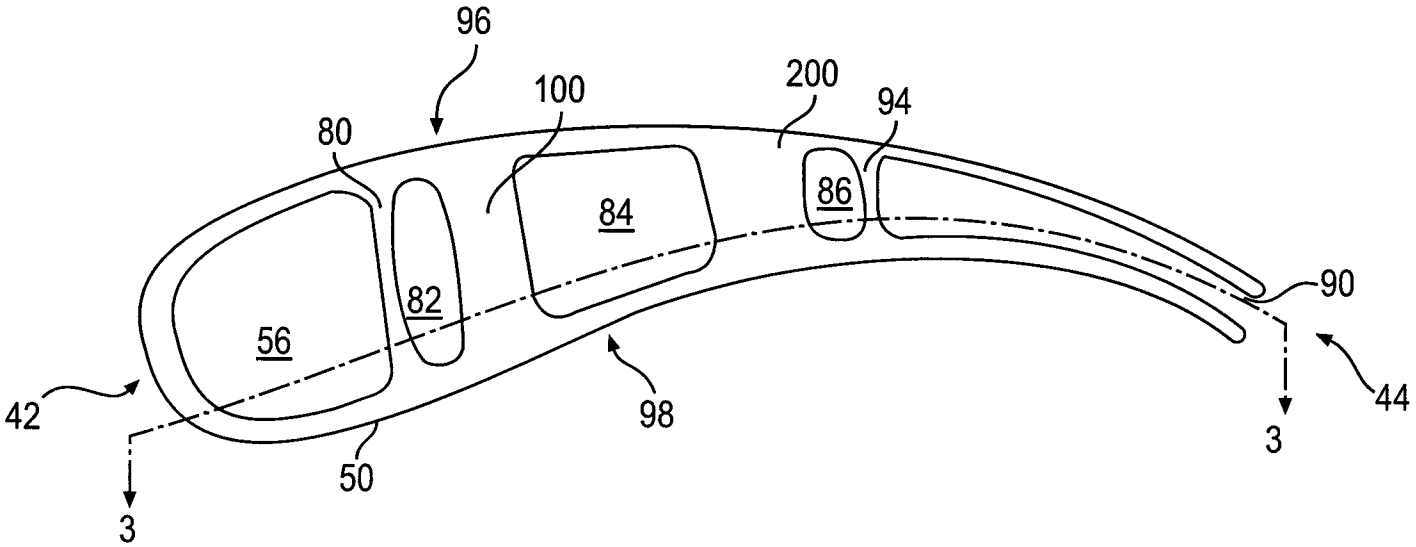
FIG. 2 is an enlarged sectional view of a turbine blade taken along lines 2-2 of FIG. 1.
Figure 3:
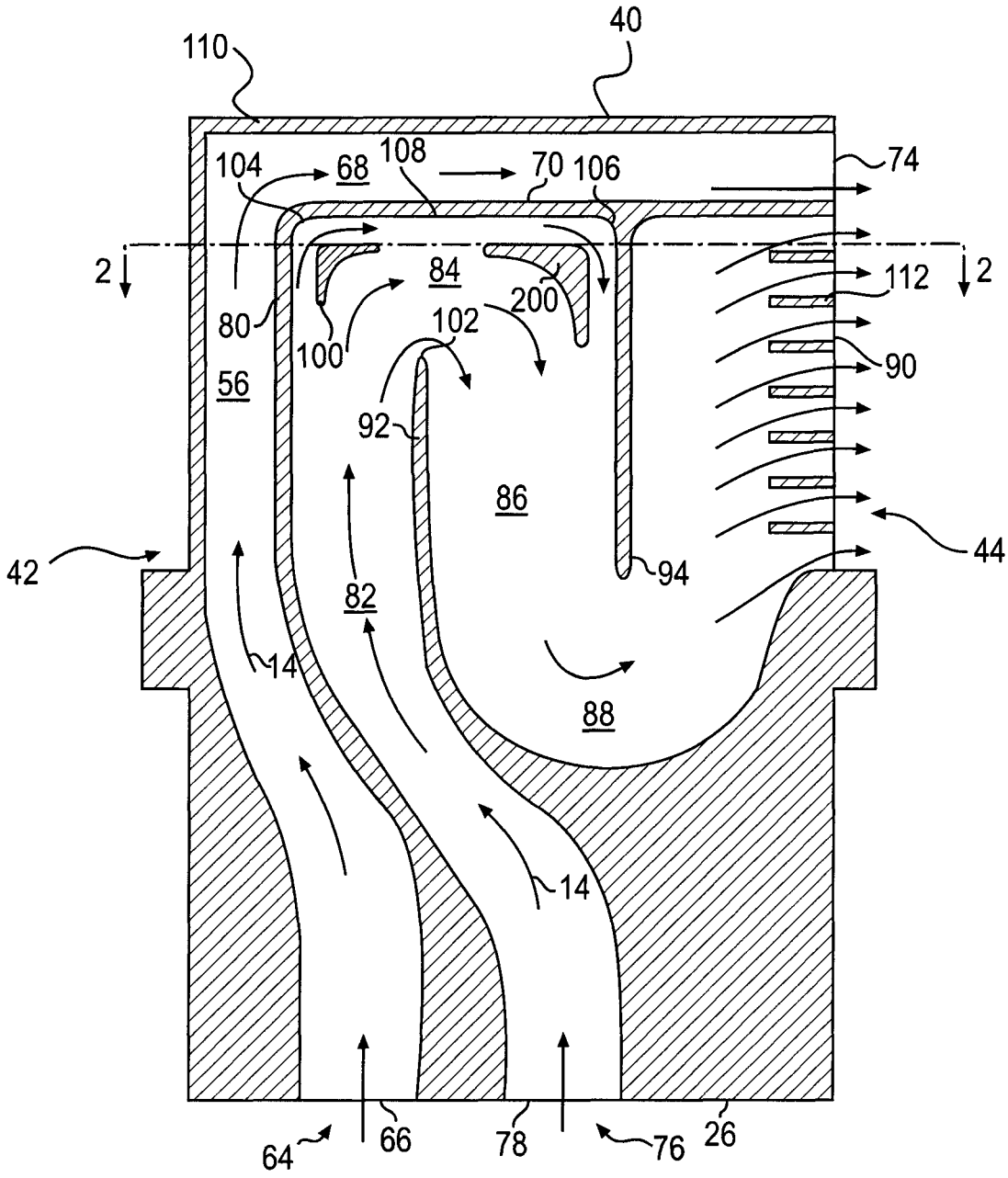
FIG. 3 is an enlarged sectional view of the turbine blade of FIG. 2 taken alone line 3-3.

FIG. 2 shows an enlarged sectional view of a turbine blade 22 taken along lines 2-2 of FIG. 1. Each of the plurality of turbine blades 22 includes a leading edge 42, and a trailing edge 44 positioned opposite the leading edge 42 (FIGS. 2 and 3). Interposed the leading edge 42 and the trailing edge 44 is a suction, or convex, side 96, and a pressure, or concave, side 98 of the turbine blade 22. Each of the plurality of turbine blades 22 may have a generally hollow configuration forming a peripheral wall 50, which, in some embodiments, may have a uniform thickness.

As shown in FIGS. 2 and 3, an arrangement for internally cooling each of the turbine blades 22 is provided. The arrangement for internal cooling may include a pair of cooling paths 64 and 76 (FIG. 3), positioned within the peripheral wall 50, and separated from one another. The cooling paths 64 and 76 may have a rectangular cross-sectional shape through which cooling fluid 14 can flow. In other embodiments, however, the cross-sectional shape of the cooling paths 64 and 76 may be, for example, circular or oval. Any number of cooling paths could be used. The cooling paths 64 and 76 may be formed by a plurality of wall members, for example first, second, third, fourth, and fifth wall members 70, 80, 92, 94, and 110, respectively, as described in more detail below (FIG. 3). Each of the wall members 70, 80, 92, 94, and 110 can be connected to, and in some instances formed integrally with, the peripheral wall 50 at both the suction side 96 and the pressure side 98 of the turbine blade 22.

Referring to FIG. 3, the first and second cooling paths 64 and 76 positioned within the peripheral wall 50 are interposed the leading edge 42 and the trailing edge 44 of each of the blades 22. The first cooling path 64 includes a first passage 56 extending between the first end 26 and the second end 40 of the turbine blade 22. The first passage 56 is interposed the leading edge 42 and a second passage 82 by the second wall member 80. Included in the second cooling path 76 is the second passage 82, which extends between the first end 26 and the second end 40 of the turbine blade 22. The second passage 82 is interposed the first passage 56 and a third passage 86 by the second wall member 80 and the third wall member 92 (FIG. 3). The second cooling path 76 further includes a third passage 86 which extends at least partially between the first end 26 and the second end 40 of the turbine blade 22. The third passage 86 is interposed the second passage 82 and a second cooling path outlet 90 by the third wall member 92 and the fourth wall member 94. As shown in FIG. 3, the second cooling path 76 can have an "S" or serpentine shape through the interior of the turbine blade 22.

As shown in FIG. 3, the first cooling path 64 can include a horizontal passage 68 disposed near the second end 40 of the blade 22. The second cooling path 76 can include an top turn 84 and a bottom turn 88. Like the passages 56, 82 and 86, the horizontal passage 68, the top turn 84, and the bottom turn 88 can be formed by the second end 40 of the blade 22 and the wall members 70, 80, 92, and 94. As illustrated in FIG. 3, a plurality of outlet flow guides 112 can be disposed at the second cooling path outlet opening 90. The outlet flow guides 112 can have any shape, for example, a rectangular cross-sectional shape as shown in FIG. 3. Furthermore, the outlet flow guides 112 in the second cooling path 76 can be evenly spaced along the second cooling path outlet opening 90.

Referring again to FIGS. 2 and 3, the turbine blade 22 includes vanes 100 and 200 disposed in the second cooling path 76 of the turbine blade 22. Each vane 100 and 200 may be referred to herein as a turning vane, a non-uniformly shaped vane, a triangle-like element, a delta-wing, a flow directing portion, a flow guide element, or the like. The term "non-uniform" or "non-uniformly shaped" as used herein refers to a vane having a varying thickness, as shown, for example, in FIG. 4. The vanes 100 and 200 may be connected to the peripheral wall 50 of the turbine blade 22. In some instances, as shown in FIG. 2, the vanes 100 and 200 may be integral with the peripheral wall 50. FIG. 2 shows each of the vanes 100 and 200 extending from the peripheral wall 50 at the suction side 96 of the turbine blade 22 to the peripheral wall 50 at the pressure side 98. The vanes 100 and 200 may be referred to as solid or unbroken, or extending continuously or in an unbroken manner between the suction side 96 and the pressure side 98. The vanes 100 and 200 may also be said to connect the suction side 96 and the pressure side 98 of the turbine blade 22. As shown in FIG. 2, and with reference to FIG. 3, in some embodiments, each of the vanes 100 and 200 may have a constant or substantially constant width from the suction side 96 to the pressure side 98.

The vanes 100 and 200 are shown in the second cooling path 76 of the turbine blade 22. The first vane 100 can be disposed at a location adjacent a first corner 104 and an inner side 108 of the first wall member 70, such that the first vane 100 is positioned between the second passage 82 and the top turn 84. The first vane 100 can also be referred to as being in a corner of either the second passage 82 or the top turn 84. Additionally, the first vane 100 can be referred to as being downstream of the second passage 82, or upstream of the top turn 84. As shown in FIG. 3, the first corner 104 is on an outer side of a turn in the second cooling path 76.

The second vane 200 can be disposed at a location near to or adjacent a second corner 106 and the inner side 108 of the first wall member 70, such that the second vane 200 is positioned between the top turn 84 and the third passage 86. The second vane 200 can also be referred to as being in a corner of either the top turn 84 or the third passage 86. Additionally, the second vane 200 can be referred to as being downstream of the top turn 84 or upstream of the third passage 86. As shown in FIG. 3, the second corner 106 is on an outer side of another turn in the second cooling path 76. Thus, the first and second vanes 100 and 200, respectively, can be located closer to an outer side than an inner side of a corresponding turn in the second cooling path 76.

As shown in FIG. 3, the first corner 104 is at a location where the second wall member 80 meets the first wall member 70, and the second corner 106 is at a location where the first wall member 70 meets the fourth wall member 94. The first vane 100 can be positioned between the first corner 104 and an end 102 of the third wall member 92, and the second vane 200 can be positioned between the second corner 106 and the end 102. Each corner 104 and 106 may be configured as a square-shaped corner or a square-shaped turn.

Each of the turning vanes 100 and 200 can have a greatest or widest cross-sectional area at the portion of the vane 100 or 200 closest to the corners 104 and 106, respectively. As shown in FIG. 3, each turning vane 100 and 200 has inner and outer curved sides, also described below with respect to FIG. 4, where the outer curved side of each of the turning vanes 100 and 200 is contoured to match the nearby or adjacent side or corner of the cooling passage.

Each vane 100 and 200 can be sized according to the geometry of the passage in which the vane is disposed. For example, as shown in FIG. 3, the third passage 86 is wider than the second passage 82. Accordingly, the vane 100, which is disposed in the second passage 82, can be made smaller than the vane 200, which is disposed in the third passage 86. Thus, for a larger, for instance a wider, fluid passage within a turbine blade, a larger vane may be provided, and vice versa.

Figure 4:
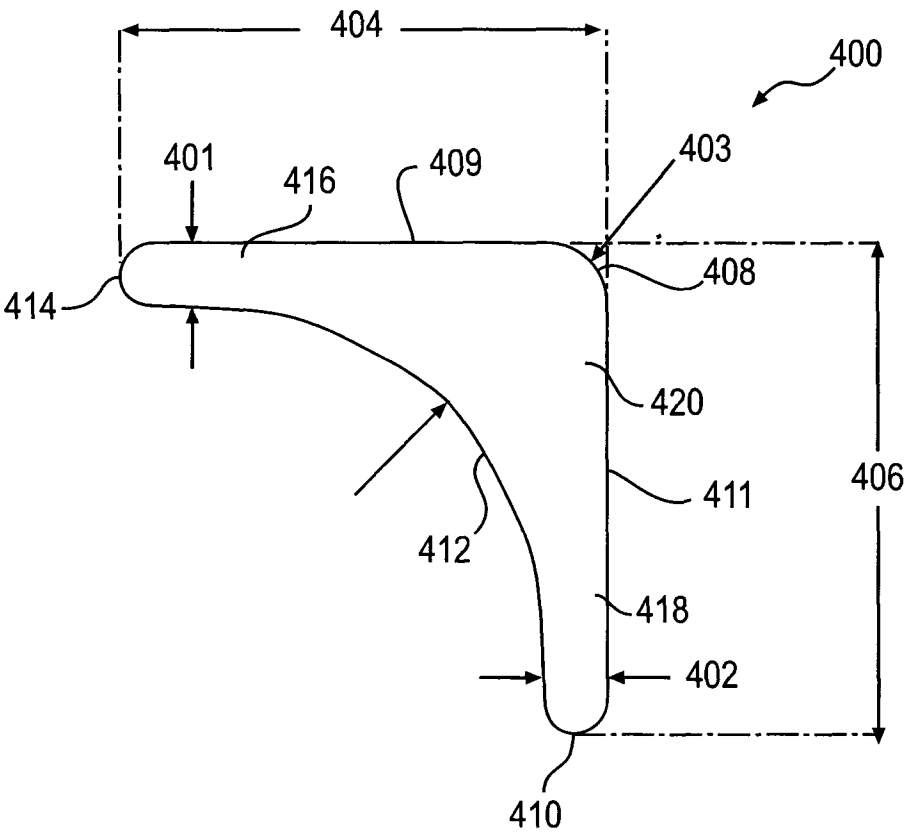
FIG. 4 is a detailed view of a general vane of the present disclosure.

FIG. 4 shows a detailed view of a triangle-like vane 400 of the present disclosure. The vane 400, which can be referred to herein as a general vane, represents a vane like the vanes 100 and 200 described above. Thus, the following description of vane 400 in FIG. 4 applies to the vanes 100 and 200 of FIGS. 2 and 3.

As shown in FIG. 4, a vane 400 includes a first leg 416 having a first thickness 401 and a second leg 418 having a second thickness 402, where the first and second thicknesses 401 and 402 can be equal. The vane 400 includes a central portion 420 having a third or central thickness 403 that is greater than the first and second thicknesses 401 and 402, respectively. As shown in FIGS. 3 and 4, the central portion can be disposed adjacent the first corner 104 or the second corner 106 of the second cooling path 76. The vane 400 has a geometry that tapers or curves from the third thickness 403 down to the first thickness 401 and the second thickness 402, such that the cross-sectional shape of the vane 400 is non-uniform. It can also be said that the vane 400 has a geometry that tapers or curves down from the third or central thickness 403 to the first thickness 401 and/or the second thickness 402. In some instances, the vane 400 can be symmetric about a line through the third thickness 403. In other instances, the vane 400 could be asymmetric. The location of the third thickness 403 is the thickest portion of the vane 400 in the cross-sectional direction of the vane 400 shown in FIG. 4. The vane 400 also includes a first width 404 and a second width 406, where the first and second widths 404 and 406 can be equal. Additionally, the vane 400 has an outer curved side 408 and an inner curved side 412 opposite the outer curved side 408, where the outer curved side 408 forms an outer side of the central portion 420. The outer curved side 408 may be referred to as a convex portion having a radius of curvature, and the inner curved side 412 may be referred to as a concave portion having another radius of curvature. As shown in FIG. 4, the radius of curvature of the outer curved side 408 may be smaller than the radius of curvature of the inner curved side 412. The vane also includes planar portions 409 and 411 extending from the outer curved side 408. The planar portion 409 forms an outer side of the first leg 416, and the planar portion 411 forms an outer side of the second leg 418. The inner curved side 412 forms an inner side of the first leg 416, the central portion 420, and the second leg 418. The vane 400 also includes a first tip 414 and a second tip 410, where the first and second tips 414 and 410 may have the same shape, for example, a rounded end shape. In some instances, a vane having only one leg could be provided, where the single leg could be similar to leg 416 or 418 of vane 400.

As mentioned above, because the size of the vane 400 increases with an increase in size of the fluid passage in which the vane is disposed, each of the dimensions, that is, the thicknesses 401, 402, and 403, and the widths 404 and 406, can also increase with an increase in size of the fluid passage. In other embodiments, however, the first thickness 401 and the second thickness 402, for example, may be held at a constant dimension regardless of the size of the fluid passage in which the vane 400 is disposed.

Figure 5:
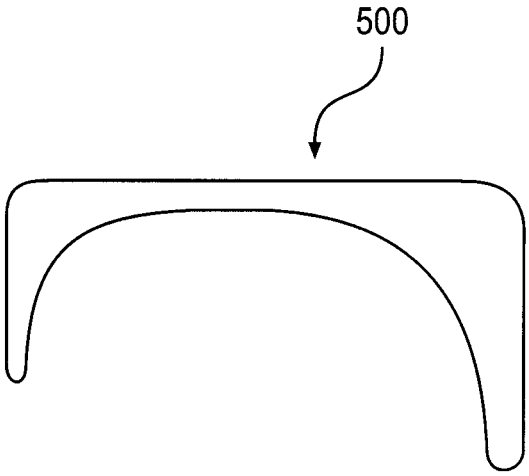
FIG. 5 is an alternative embodiment of a general vane of the present disclosure.

Although the vanes 100 and 200 of FIG. 3 exhibit the shape of the general vane 400 shown in FIG. 4, the vanes 100 and 200 may be connected. As shown in the alternative embodiment in FIG. 5, for example, the vanes 100 and 200 may be connected, through the top turn 84 for instance (FIG. 3), to form a single vane 500. The single vane 500 may be referred to herein as a "full delta-shaped turning vane."

INDUSTRIAL APPLICABILITY

The above-mentioned apparatus, while being described as an apparatus for cooling a turbine blade, can be applied to any other blade or airfoil requiring temperature regulation. For example, turbine nozzles in a GTE could incorporate the cooling apparatus described above. Moreover, the disclosed cooling apparatus is not limited to GTE industry application. The above-described principal, that is, using non-uniformly shaped vanes for directing flow of a cooling fluid, could be applied to other applications and industries requiring temperature regulation of a working component.

The following operation will be directed to the first stage turbine assembly 12; however, the cooling operation of other airfoils and stages (turbine blades or nozzles) could be similar.

A portion of the compressed fluid from the compressor section of the GTE is bled from the compressor section and forms the cooling fluid 14 used to cool the first stage turbine blades 22. The compressed fluid exits the compressor section, flows through an internal passage of a combustor discharge plenum, and enters into a portion of the fluid flow channel 16 as cooling fluid 14. The flow of cooling fluid 14 is used to cool and prevent ingestion of hot gases into the internal components of the GTE. For example, the air bled from the compressor section flows into a compressor discharge plenum, through spaces between a plurality of combustion chambers, and into the fluid flow channel 16 in the support structure 15 (FIG. 1). After passing through the fluid flow channel 16 shown in FIG. 1, the cooling fluid enters the cooling fluid inlet opening 34 between the first end 26 of the turbine blade 22 and the bottom 32 of the root retention slot 30 in the disc 24. The cooling fluid inlet opening 34 is fluidly connected to the first and second cooling paths 64 and 76, respectively, in the interior of the turbine blade 22 (FIG. 3).

As shown in FIG. 3, a first portion of the cooling fluid 14, after having passed through the cooling fluid inlet opening 34 (FIG. 1), enters the first cooling path 64. The cooling fluid 14 enters the first cooling path inlet opening 66 from the cooling fluid inlet opening 34, and travels radially along the first passage 56, absorbing heat from the peripheral wall 50 and the second wall member 80. The cooling fluid flows from the first passage 56 to the horizontal passage 68 and out of the turbine blade 22 through the first cooling path outlet 74.

A second portion of the cooling fluid 14, after having passed through the cooling fluid inlet opening 34 (FIG. 1), enters the second cooling path 76. For example, cooling fluid 14 enters the second cooling path inlet opening 78 from the cooling fluid inlet opening 34, and travels radially along the second passage 82, absorbing heat from the second wall member 80 and the third wall member 92 before entering the top turn 84.

As the cooling fluid 14 flows from the second passage 82 to the top turn 84, the fluid 14 flows around the first vane 100 disposed in the flow path. As shown in FIG. 3, the cooling fluid 14 flows on both sides of the first vane 100, and in close proximity to the first corner 104 and the end 102 of the third wall member 92. With the first vane 100 disposed in the fluid flow path, the cooling fluid 14 fills the space of the second cooling path 76 as the fluid 14 flows from the second passage 82 to the top turn 84.

After passing by the first vane 100, the cooling fluid 14 then flows around the second vane 200 downstream of the first vane 100. As shown in FIG. 3, the cooling fluid 14 flows on both sides of the second vane 200, and in close proximity to the second corner 106 and the end 102 of the third wall member 92. With the second vane 200 disposed in the fluid flow path, the cooling fluid 14 fills the space of the second cooling path 76 as the fluid 14 flows from the top turn 84 to the third passage 86.

As the cooling fluid 14 flows over each vane 100 and 200, the cooling fluid 14 flows from the first leg 416 to the second leg 418, passing by the central portion 410 disposed between the first and second legs 416 and 418. Therefore, the first leg 416 can be said to be disposed upstream of the central portion 420 and the second leg 418, and the central portion 420 can be said to be disposed upstream of the second leg 418. Thus, the first thickness 401 is disposed upstream from the central thickness 403, and the central thickness 403 is disposed upstream from the second thickness 402. The first leg 416 or the first thickness 401 may be referred to as the most upstream portion of either vane 100 or 200, and the second leg 418 or the second thickness 402 may be referred to as the most downstream portion of either vane 100 or 200.

After passing over the first and second vanes 100 and 200, respectively, the cooling fluid 14 enters the third passage 86, where additional heat can be absorbed from the third wall member 92 and the fourth wall member 94 before entering the bottom turn 88. After passing through the bottom turn 88, the cooling fluid exits the second cooling path 76 through the second cooling path outlet opening 90 along the trailing edge 44 to be mixed with the combustion gases.

In some instances, the turbine blade 22 may be manufactured by a known casting process, for example investment casting. During investment casting, the blade 22 can be formed having a partially vacant internal area including the cooling paths 64 and 76 described above to allow for the flow of cooling fluid. Investment casting the turbine blade 22 forms the vanes 100 and 200 at the time of casting. Because the vanes 100 and 200 are cast with the blade 22, the vanes 100 and 200 are integral to the peripheral wall 50 of the turbine blade 22. As described above with respect to FIG. 2, the vanes 100 and 200 can be formed integrally with the peripheral wall 50 of the suction side 96 and the pressure side 98 of the turbine blade 22. In some instances, the casting material for the blade 22, and therefore also for the vanes 100 and 200, may be metal. In some cases, the turbine blade may be cast as a single crystal, or monocrystalline solid, and may be made of a superalloy.

Typical arrangements for directing fluid through a turbine blade include passages extending through an interior of the blade. While the passages generally include one or more turns or corners through which the fluid is directed, these turns can cause undesired pressure losses. The turns and corners are susceptible to flow separation, that is, dead-zones or vacant space in a flow path without fluid flow. In addition to pressure losses, using larger passages for cooling can also result in flow separation from the increased cross sectional area of the passages. When the fluid flows at a high velocity through the passages, there is often insufficient time for flow expansion or diffusion, which results in flow separation, or chaos, within the turbine blade. When the flow of cooling fluid separates within the passages, the cooling fluid does not fill the space of the passages, and therefore the heat transfer coefficient may decrease. With a decrease in the heat transfer coefficient, there is a risk of overheating and problems related to premature wear of the turbine blades, which can prevent overall efficient operation of the GTE.

The above-described apparatus provides more efficient use of the cooling air bled from the compressor section of a GTE in order to facilitate increased component life and efficiency of the GTE. Providing the vanes as described can reduce the pressure drop and flow separation in the cooling paths, thereby increasing the heat transfer coefficient in the turns of the cooling paths and also downstream of the turns. Increasing the heat transfer coefficient in this manner can cause more effective cooling of the turbine blade, which reduces the temperature of the metal of the blade. Reducing the blade temperature reduces stress imparted on the blade, which increases the blade service life. Increasing the blade service life allows the turbine blades to be used for longer periods, thus reducing the frequency of necessary turbine section inspections for a given GTE.

The vanes of the disclosed apparatus are particularly suited to improve turbine blade cooling because they exhibit a non-uniform shape. Providing the described vanes reduces the cross-sectional area of the flow passages through which the cooling fluid can flow, which thereby reduces flow separation and chaos, that is, dead-zones are minimized or eliminated. The delta-wing or triangle-like shaped vanes described above facilitate cooling by ensuring that the internal flow passages of the turbine blade are filled with cooling fluid. A larger vane can be provided for a larger cooling passage, and a smaller vane can be provided for a smaller cooling passage, thereby ensuring that there are few or no dead-zones for a passage of a given size. The shape of the vanes helps guide the flow of cooling fluid and push the flow toward the areas usually susceptible to flow separation, that is, the turns and corners of the flow passages. For example, as shown in FIG. 3, the vane 100 helps to push the flow of cooling fluid 14 into the first corner 104, the vane 200 helps to push the flow of cooling fluid 14 into the second corner 106, and the vanes 100 and 200 both help to push the flow of cooling fluid 14 towards the end 102 of the third wall member 92. Thus, due to the non-uniform shape of the vanes, pressure losses in the cooling passages are prevented, and cooling fluid flows through the entire space of the flow passages, including the corners and curves where dead-zones typically exist. Therefore, blade cooling efficiency can be increased, resulting in the convenience and cost savings from an increased blade service life.

In addition to improving blade cooling efficiency, the integration of the vanes with the peripheral wall of the turbine blade, formed during casting the vanes with the rest of the turbine blade, provides the simplicity of fewer separate parts to the overall turbine blade structure. Because the vanes are integrally formed via investment casting, complexity is reduced, as is any risk of the vanes detaching from the peripheral walls of the turbine blade and hindering GTE performance. Thus, casting the vanes in the manner described facilitates production of durable and reliable turbine blades.

The foregoing description relates to an exemplary embodiment of the turbine cooling apparatus. As an alternative, one or both of the vanes 100 and 200 could be disposed in either the first cooling path 64 or the second cooling path 76, or in any other cooling path formed within the turbine blade 22. Additionally, although only two vanes 100 and 200 are shown in FIGS. 2 and 3, any number of vanes could be provided in the turbine blade 22. Furthermore, although FIG. 3 shows turning vanes 100 and 200 disposed in square-shaped turns of cooling passages, a vane can be disposed at a turn in a fluid passage that is not square-shaped. For example, a vane may be provided in a cooling passage having an obtuse or an acute angled turn. In addition to including a vane in a cooling path of the turbine blade 22, the turbine blade 22 may also include a turbulating element for imparting turbulence into the flow of cooling fluid 14. A turbulating element may be, for example, a radially disposed strip in a passage of one or both of the first cooling path 64 and the second cooling path 76. A turbulating element may further enhance the internal heat transfer coefficient for effective blade cooling and prevention of overheating and premature wear.

It will be apparent to those skilled in the art that various modifications and variations can be made to the disclosed turbine cooling system. Other embodiments will be apparent to those skilled in the art from consideration of the specification and practice of the disclosed system and method. It is intended that the specification and examples be considered as exemplary only, with a true scope being indicated by the following claims and their equivalents.

What is claimed is:

1. A turbine blade for a gas turbine engine, comprising:

at least one internal cooling path; and a first vane disposed at a first location in the at least one internal cooling path; and a second vane disposed at a second location in the at least one internal cooling path downstream from the first location;

wherein each of the first vane and the second vane includes:

a central portion;

a first leg extending in a first direction from the central portion; and a second leg extending in a second direction from the central portion, wherein the central portion has a thickness greater than a thickness of the first leg or a thickness of the second leg, wherein the first vane is disposed adjacent a first corner of a wall forming the at least one internal cooling path, and the second vane is disposed adjacent a second corner of the wall forming the at least one internal cooling path, wherein a cross-sectional area of the first vane is greatest at a portion of the first vane closest to the first corner of the wall, and wherein a cross-sectional area of the second vane is greatest at a portion of the second vane closest to the second corner of the wall.

2. The turbine blade of claim 1, further comprising:

each of the first vane and the second vane comprising:

an outer curved side forming an outer side of the central portion;

a first planar portion forming an outer side of the first leg;

a second planar portion forming an outer side of the second leg; and an inner curved side forming an inner side of the central portion, the first leg, and the second leg.

3. The turbine blade of claim 1, further comprising:

each of the first vane and the second vane comprising:

a first width extending from a first tip of the first leg to an outer side of the second leg; and a second width extending from a second tip of the second leg to an outer side of the first leg, wherein the first width is equal to the second width.

4. The turbine blade of claim 1, wherein each of the first vane and the second vane is integral to a suction side and a pressure side of the turbine blade.

5. A turbine blade for a gas turbine engine, comprising:

at least one internal cooling path; and a first vane disposed at a first location in the at least one internal cooling path; and a second vane disposed at a second location in the at least one internal cooling path downstream from the first location;

wherein each of the first vane and the second vane includes:

a central portion; and a leg extending from the central portion, wherein the central portion has a thickness greater than a thickness of the leg, wherein the first vane is disposed adjacent a first corner of a wall forming the at least one internal cooling path, and the second vane is disposed adjacent a second corner of the wall forming the at least one internal cooling path, wherein a cross-sectional area of the first vane is greatest at a portion of the first vane closest to the first corner of the wall, and wherein a cross-sectional area of the second vane is greatest at a portion of the second vane closest to the second corner of the wall.

6. The turbine blade of claim 5, wherein the at least one cooling path comprises:

a first passage; and a second passage downstream of the first passage, wherein the second passage has a larger cross sectional area than the first passage, and wherein the first vane is disposed downstream of the first passage, and the second vane is disposed upstream of the second passage, wherein a cross-sectional area of the first vane is smaller than a cross-sectional area of the second vane.

7. The turbine blade of claim 5, wherein a cross-sectional area of the first vane is smaller than a cross-sectional area of the second vane.

8. The turbine blade of claim 5, further comprising:

a suction side; and a pressure side opposite the suction side, wherein the first vane and the second vane extend continuously from the suction side to the pressure side.

9. The turbine blade of claim 8, wherein a width of each of the first vane and the second vane is constant between the suction side and the pressure side.

10. The turbine blade of claim 5, wherein each of the first vane and the second vane further comprises:

an additional leg extending from the central portion, wherein the central portion has a thickness greater than a thickness of the additional leg.

11. A turbine blade for a gas turbine engine, comprising:

an internal cooling path;

a first vane disposed at a first location in the cooling path; and a second vane disposed at a second location in the cooling path downstream from the first location, wherein the first and second vane each taper from a central thickness to a first thickness, and from the central thickness to a second thickness, wherein the first thickness is disposed upstream from the central thickness in the cooling path, and wherein the central thickness is disposed upstream from the second thickness in the cooling path, wherein the first vane is disposed adjacent a first corner of a wall forming the cooling path, and the second vane is disposed adjacent a second corner of the wall forming the cooling path, wherein a cross-sectional area of the first vane is greatest at a portion of the first vane closest to the first corner of the wall, and wherein a cross-sectional area of the second vane is greatest at a portion of the second vane closest to the second corner of the wall.

12. The turbine blade of claim 11, wherein a cross-sectional area of the first vane is smaller than a cross-sectional area of the second vane.

13. The turbine blade of claim 11, wherein the first vane and the second vane have nonuniform cross-sectional shapes.

14. The turbine blade of claim 11, further comprising:

a suction side; and a pressure side opposite the suction side, wherein the first and second vanes extend continuously from the suction side to the pressure side.

15. The turbine blade of claim 14, wherein a width of the first and second vanes is constant between the suction side and the pressure side.

* * * * *